US009146519B2

(12) United States Patent
Isogai

(10) Patent No.: US 9,146,519 B2
(45) Date of Patent: Sep. 29, 2015

(54) SHEET CONVEYING DEVICE AND IMAGE FORMING APPARATUS HAVING SAME

(71) Applicant: Kyocera Document Solutions Inc., Osaka (JP)

(72) Inventor: Yoji Isogai, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/077,396

(22) Filed: Nov. 12, 2013

(65) Prior Publication Data

US 2014/0133894 A1 May 15, 2014

(30) Foreign Application Priority Data

Nov. 12, 2012 (JP) ..... 2012-248345

(51) Int. Cl.

| | |
|---|---|
| ***G03G 15/00*** | (2006.01) |
| ***B65H 29/12*** | (2006.01) |
| ***B65H 29/14*** | (2006.01) |
| ***B65H 29/70*** | (2006.01) |
| ***B65H 43/08*** | (2006.01) |

(52) U.S. Cl.

CPC ..... *G03G 15/657* (2013.01); *B65H 29/125* (2013.01); *B65H 29/14* (2013.01); *B65H 29/70* (2013.01); *B65H 43/08* (2013.01); *G03G 15/5029* (2013.01); *G03G 15/6591* (2013.01); *B65H 2301/51212* (2013.01); *B65H 2301/512125* (2013.01); *B65H 2511/17* (2013.01); *B65H 2511/416* (2013.01); *B65H 2511/51* (2013.01); *B65H 2513/104* (2013.01); *B65H 2513/108* (2013.01); *B65H 2513/50* (2013.01); *B65H 2553/414* (2013.01); *G03G 2215/00751* (2013.01)

(58) Field of Classification Search

CPC ..... B65H 7/04
USPC ..... 399/407
See application file for complete search history.

(56) References Cited

U.S. PATENT DOCUMENTS

| | | | | |
|---|---|---|---|---|
| 5,775,690 | A * | 7/1998 | Quesnel et al. | 271/242 |
| 5,897,250 | A * | 4/1999 | Hirai et al. | 399/404 |
| 6,669,189 | B2 * | 12/2003 | Seto et al. | 271/186 |

(Continued)

FOREIGN PATENT DOCUMENTS

| | | |
|---|---|---|
| JP | 2000-309450 | 11/2000 |
| JP | 2004-269167 | 9/2004 |
| JP | 2006-151564 | 6/2006 |

OTHER PUBLICATIONS

Japanese Office Action for Application No. 2012-248345, dated Jan. 20, 2015, 4 pages.

*Primary Examiner* — Anthony Nguyen
(74) *Attorney, Agent, or Firm* — K&L Gates LLP

(57) ABSTRACT

A sheet conveying device includes upstream side rollers; discharge rollers located downstream from the upstream side rollers in the feeding direction of sheets, to discharge sheets to a discharge tray; a reflective optical detector located between the discharging rollers and the upstream side rollers, to emit light and to receive light reflected off of the sheets; and a recognizing unit to detect, based on output of the detector, whether or not a sheet is present at a detection region of the detector. When a sheet is fed over a conveying path inclined with respect to a detection face of the detector, the discharge rollers feed the sheet in a bent state between the upstream side rollers and the discharge rollers, so that the sheet is close to the detector or the sheet is close to being perpendicular to an optical axis of the detector.

12 Claims, 11 Drawing Sheets

(56) References Cited

U.S. PATENT DOCUMENTS

| | | | | |
|---|---|---|---|---|
| 7,604,233 | B2 * | 10/2009 | Nakazawa et al. | 271/242 |
| 8,123,209 | B2 * | 2/2012 | Kubota et al. | 270/58.07 |
| 2005/0140087 | A1 * | 6/2005 | Sano et al. | 271/276 |
| 2009/0033028 | A1 * | 2/2009 | Yahata et al. | 271/259 |
| 2009/0295083 | A1 * | 12/2009 | Kitan | 271/306 |
| 2010/0140861 | A1 * | 6/2010 | Kubota et al. | 270/58.08 |
| 2011/0248440 | A1 * | 10/2011 | Sugiyama et al. | 271/10.11 |
| 2012/0282004 | A1 * | 11/2012 | Furuhashi et al. | 399/408 |

* cited by examiner

SHEET CONVEYING DEVICE AND IMAGE FORMING APPARATUS HAVING SAME

INCORPORATION BY REFERENCE

This application is based upon and claims the benefit of priority from the corresponding Japanese Patent Application No. 2012-248345, filed on Nov. 12, 2012, the entire contents of which are incorporated herein by reference.

BACKGROUND

The present disclosure relates to a sheet conveying device for feeding sheets, and to an image forming apparatus having same.

Image forming apparatuses such as photocopiers, multi-functional peripherals, printers, and facsimiles, have sheet conveying devices to feed sheets. The sheet conveying device is provided with sensors to detect whether or not a sheet is present, so as to detect that a sheet has arrived at a predetermined point or has passed over a predetermined point. There are situations where reflective optical sensors are used for the sensors.

There is known a sheet conveying device capable of detecting sheets using reflective optical sensors. Specifically, the sheet conveying device includes a first sheet conveying unit which feeds a sheet after the leading edge of the sheet is contacted to correct skewing of the sheet; a second sheet conveying unit situated upstream in the feed direction of the first sheet conveying unit to feed a sheet fed from a sheet feed device to the first sheet conveying unit; a seat conveying unit located between the first and second sheet conveying unit; and a reflective optical sensor located near the seat conveying unit, to detect whether or not there is a sheet passing through the sheet conveying unit. With this sheet conveying device, the amount of contact of the sheet against the first sheet conveying unit by the second sheet conveying unit is determined using the detection results of the reflective optical sensor. The sheet conveying device has an upper conveying guide and a lower conveying guide which hold a sheet from both the front and back directions, positioned with a tapered form as to the feed direction. The angle between the upper conveying guide and an optical axis of the reflective optical sensor and the angle between the lower conveying guide and the optical axis of the reflective optical sensor are set to a predetermined angle enabling detection regardless of the type of sheet being fed. With this sheet conveying device, conditions relating to sheet detection, such as distance between sheet and sensor, angle between sheet and detection face of sensor, and so forth, are set so as to satisfy a range where sheets can be accurately detected, so from the leading end to the trailing end of the sheet can be accurately detected using a single reflective optical sensor.

Arrival and passage of sheets are detected using optical sensors with some image forming apparatus. Transmissive optical sensors and reflective optical sensors are used as optical sensors.

The transmissive optical sensor includes a light-emitting element, a light-receiving element, an actuator (rotating plate, fan-shaped for example) which rotates (turns) upon coming into contact with a sheet, and so forth. When there is no sheet, the actuator interrupts the light from the light-emitting element to the light-receiving element. On the other hand, when a sheet arrives, the actuator is rotated by the sheet, and the state in which light from the light-emitting element to the light-receiving element is not interrupted continues until the sheet completely passes.

On the other hand, a reflective optical sensor includes a light-emitting element which emits light toward the conveyance path of the sheets, and a light-receiving element which receives reflected light emitted by the light-emitting element. If there is no sheet in a detection range, the amount of light received by the light-receiving element from reflection is small, but if a sheet exists in the detection region (from the time that the sheet arrives until completely passing), the amount of light received by the light-receiving element from reflection is great.

Thus, both transmissive optical sensors and reflective optical sensors take advantage of the difference in the output of the light-receiving element depending on whether or not there is a sheet at the position where the optical sensor is installed (detection region), to detect whether or not a sheet currently exists at the position where the optical sensor is installed.

Now, image forming apparatuses sometimes print on transparent or semi-transparent sheets, such as sheets for overhead projectors (OHPs), hereinafter interchangeably referred to as "overhead transparency sheets" or "OHP sheets". Accordingly, there are situations where image forming apparatuses use only transmissive optical sensors and not reflective optical sensors, since sheets, through which light can pass, can be accurately detected. On the other hand, there are some situations where reflective optical sensors are used when transmissive optical sensors cannot be used due to reasons such as insufficient space to install actuators, actuators becoming a load on sheet conveyance, and so forth.

Now, light-receiving elements of reflective optical sensors have more trouble receiving reflected light the greater the angle of the sheet (feed direction of the sheet) deviates from being at a right angle as to the optical axis of the light-emitting element. Also, the greater the distance is between the reflective optical sensor and the sheet, the more difficulty the light-receiving element has in receiving reflected light.

Accordingly, the angle between sheets being fed and the optical axis of the light-emitting element of the reflective optical sensor need to be kept within a certain angle range, so as to keep the output of the light-receiving element within an output range of when passing of sheet is detected, so as to enable detection of the sheets. Particularly, the angle between the passing sheets and the optical axis of the light-emitting element is preferably close to 90 degrees for sheets, through which light can pass, such as OHP sheets and the like.

However, there are situations where reflective optical sensors cannot be installed such that the optical axis of the light-emitting element is perpendicular with respect to the conveyance face of the sheet, due to restrictions in installation space. There are also situations where there are multiple angles of sheets passing through a detection region of a reflective optical sensor with respect to the optical axis of the light-emitting element. Accordingly, there is a problem in that there are situations where the presence or absence of sheets (OHP sheets in particular) cannot be accurately detected using reflective optical sensors. Inaccurate sheet detection results can result in sheet conveyance control, based on sensor detection results, not being appropriately carried out.

The above-described sheet conveying device has an upper conveying guide and a lower conveying guide located such that the angle of sheets with respect to the optical axis of the reflective optical sensor is kept within a certain range, and the reflective optical sensor is located at a position capable of detecting sheets regardless of the type of sheet being fed. Thus, the sheet conveying device can even accurately detect OHP sheets. However, there have been situations where whether or not a sheet is present could not be accurately detected (particularly OHP sheets), in situations where there is a limitation in the position or angle of installation of the reflective optical sensor, or situations where there are multiple patterns in sheet inclination.

SUMMARY

A sheet conveying device according to an embodiment of the present disclosure includes upstream side rollers configured to feed sheets, discharge rollers, a reflective optical detector, and a recognizing unit. The discharge rollers are located downstream from the upstream side rollers in a feeding direction of the sheets, and are configured to discharge sheets to a discharge tray. The reflective optical detector is located between the discharging rollers and the upstream side rollers, and is configured to emit light, and to receive light reflected off of the sheets. The recognizing unit is configured to detect, based on the output of the detector, whether or not a sheet is present at a detection region of the detector. When a sheet is fed over a conveying path inclined with respect to a detection face of the detector, the discharge rollers feed the sheet in a bent state between the upstream side rollers and the discharge rollers, so that the sheet is close to the detector or the sheet is close to being perpendicular to an optical axis of the detector.

An image forming apparatus according to another embodiment of the present disclosure includes a sheet feeding unit, a conveying unit, an image forming unit, a fixing unit, and a finisher. The sheet feeding unit is configured to feed sheets to the conveying unit. The conveying unit is configured to feed the sheets fed from the sheet feeding unit. The image forming unit is configured to form toner images on the sheets fed by the conveying unit. The fixing unit is configured to fix, to the sheets, the toner images formed on the sheets at the image forming unit. The finisher is configured to perform finishing on the sheets to which toner image have been fixed at the fixing unit. The finisher includes a sheet conveying unit. The sheet conveying unit includes upstream side rollers configured to feed sheets, discharge rollers, a reflective optical detector, and a recognizing unit. The discharge rollers are located downstream from the upstream side rollers in a feeding direction of the sheets, and are configured so as to discharge sheets to a discharge tray. The reflective optical detector is located between the discharging rollers and the upstream side rollers, and is configured to emit light, and to receive light reflected off of the sheets. The recognizing unit is configured to detect, based on the output of the detector, whether or not a sheet is present at a detection region of the detector. In a situation that a sheet is fed over a conveying path inclined with respect to a detection face of the detector, the discharge rollers feed the sheet in a bent state between the upstream side rollers and the discharge rollers, so that the sheet comes close to the detector or the sheet comes close to being perpendicular to an optical axis of the detector.

Additional features and advantages are described herein, and will be apparent from the following Detailed Description and the figures.

DETAILED DESCRIPTION

An embodiment of the present disclosure will be described with reference to FIGS. 1 through 9. A multifunctional peripheral 100 serving as an image forming apparatus, including a finisher 1 serving as a sheet conveying device, will be described as an example of the present embodiment. Specifically, the finisher 1 corresponds to the sheet conveying device in the following description. However, it should be noted that elements described in the present embodiment, such as configurations, placement, and so forth, are only examples for the sake of description and are not restrictive regarding the scope of the disclosure.

Figure 1:
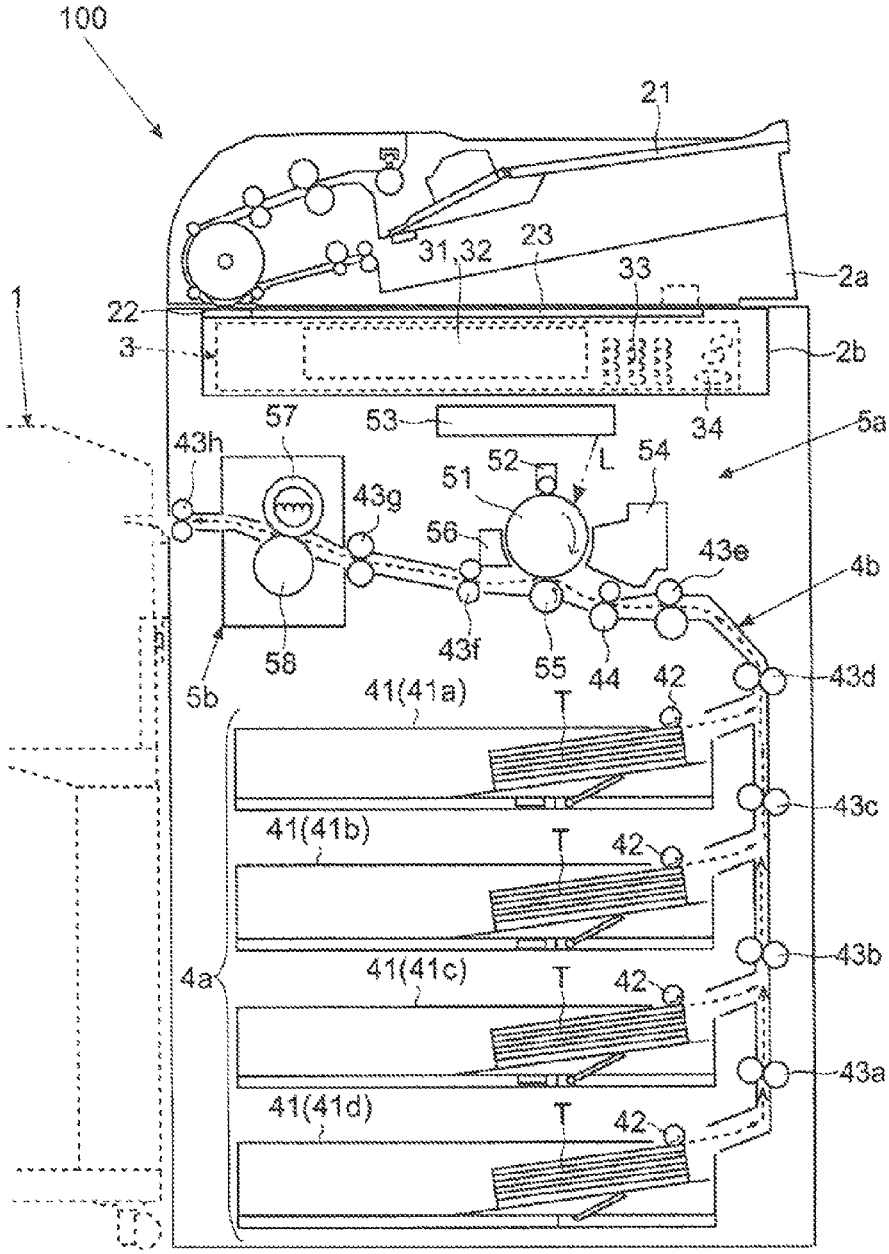
FIG. 1 is a diagram illustrating the configuration of a multifunctional peripheral according to an embodiment of the present disclosure.

First, an overview of the multifunctional peripheral 100 according to an embodiment will be described with reference to FIG. 1. FIG. 1 is a diagram illustrating the configuration of the multifunctional peripheral 100.

As illustrated in FIG. 1, the finisher 1 is connected to the left side face of the multifunctional peripheral 100 (the finisher 1 is partially illustrated by dotted lines in FIG. 1). A document conveying unit 2*a* and image reading unit 2*b* are located at the top of the multifunctional peripheral 100. The document conveying unit 2*a* feeds documents located on a document tray 21 thereof, one sheet at a time, to an automatic document feeder (ADF) reading contact glass 22 which is the reading position of the image reading unit 2*b*. Multiple documents to be copied or scanned can be positioned in the document tray 21. Also, the document conveying unit 2*a* is provided with a turning fulcrum (not illustrated) thereof at the far side thereof, whereby the document conveying unit 2*a* can be lifted and documents such as books can be placed on a flatbed contact glass 23.

The image reading unit 2*b* reads images of the documents and generates image data. Inside the image reading unit 2*b* are provided optical members such as a moving frame having an exposure lamp, minor, and so forth, which moves in the horizontal direction (to the left and right in FIG. 1), an image sensor such as a charge-coupled device (CCD) sensor, and lenses and the like, though these are omitted from illustration. The image reading unit 2*b* emits light onto documents passing over the ADF scanning contact glass 22 or placed on the flatbed contact glass 23, performs analog-to-digital (A/D) conversion of output values of each pixel in the image sensor which has received the light reflected off of the document, and generates image data. The multifunctional peripheral 100 prints based on the scanned image data (copy function) or transmission or the like of the obtained image data (scan function, facsimile (FAX) function).

An operating panel 3 is provided on the front upper face of the multifunctional peripheral 100, that is, on the front face of the image reading unit 2*b*, as indicated by dotted lines in FIG. 1. The operating panel 3 serves as an input unit to accept an input of settings such as copying and the like, and to display various types of information. The operating panel 3 includes a touch panel unit 31 and liquid crystal display unit 32. The liquid crystal display unit 32 displays the state of the multifunctional peripheral 100, and various setting screens including keys and buttons for setting functions relating to jobs to be executed. Keys and buttons pressed at the touch panel unit 31 are recognized by the operating panel 3. The operating panel 3 is also provided with hard keys such as a numerical keypad 33 for input of numbers and the like, and a start key 34 to instruct starting of a job.

The multifunctional peripheral 100 further includes a sheet feed unit 4*a*, a conveying unit 4*b*, an image forming unit 5*a*, a fixing unit 5*b*, and so forth, within its housing.

The sheet feed unit 4*a* includes multiple cassettes 41 (41*a* through 41*d*) to store and supply sheets T used for printing. The cassettes 41 can store multiple sheets of different sizes. Each of the cassettes 41*a* through 41*d* is provided with a pick-up roller 42 which rotates to feed out the sheets T one at a time to the conveying unit 4*b*.

The conveying unit 4*b* includes a path over which to feed the sheets T through the apparatus. The conveying unit 4*b* also includes multiple roller pairs 43 (43*a* through 43*h* illustrated in FIG. 1 in order from upstream direction of conveyance of the sheets T) which rotate at the time of feeding the sheets T, thereby feeding the sheets T, and a registration roller pair 44 where a fed sheet T is held short of the image forming unit 5*a* and fed in synchronization with formation of a toner image at the image forming unit 5*a*.

The image forming unit 5*a* forms a toner image according to the image data, and transfers the formed toner image onto the fed sheet T. The image data may be image data of the document acquired by the image reading unit 2*b*, image data transmitted from a computer 200 (see FIG. 3) connected to the multifunctional peripheral 100, or the like.

The image forming unit 5*a* includes a rotatably supported photosensitive drum 51, and other equipments located in the periphery thereof, such as a charger 52, exposing unit 53, developing unit 54, transfer roller 55, cleaning unit 56, and so forth.

The photosensitive drum 51 is located around the middle of the image forming unit 5*a*, and is rotatable in a predetermined direction. The charger 52 charges the photosensitive drum 51 to a predetermined potential. The exposing unit 53 outputs a laser beam L based on the image data, and scans the surface of the charged photosensitive drum 51 so as to perform exposing, thereby forming an electrostatic latent image corresponding to the image data. The developing unit 54 supplies toner to the electrostatic latent image formed on the photosensitive drum 51 to form a toner image. The transfer roller 55 presses against the photosensitive drum 51 to form a nip. The registration roller pair 44 feeds the sheet T to the nip at the appropriate timing. As the sheet T and toner image enter the nip, a predetermined voltage is applied to the transfer roller 55. Thus, the toner image on the photosensitive drum 51 transferred to the sheet T. The cleaning unit 56 removes toner and the like remaining on the photosensitive drum 51 after transfer of the toner image.

The fixing unit 5*b* fixes the toner image transferred onto the sheet T. The fixing unit 5*b* according to an embodiment primarily includes a heating roller 57 having a built-in heater (not illustrated), and a pressure roller 58. The heating roller 57 and pressure roller 58 press against each other to form a nip. As the sheet T passes through this nip, the toner carried on the sheet T is fused by heating, and thus the toner image is fixed on the sheet T. The sheet T after toner fixing (sheet T after printing) is then fed toward the finisher 1.

Figure 2:
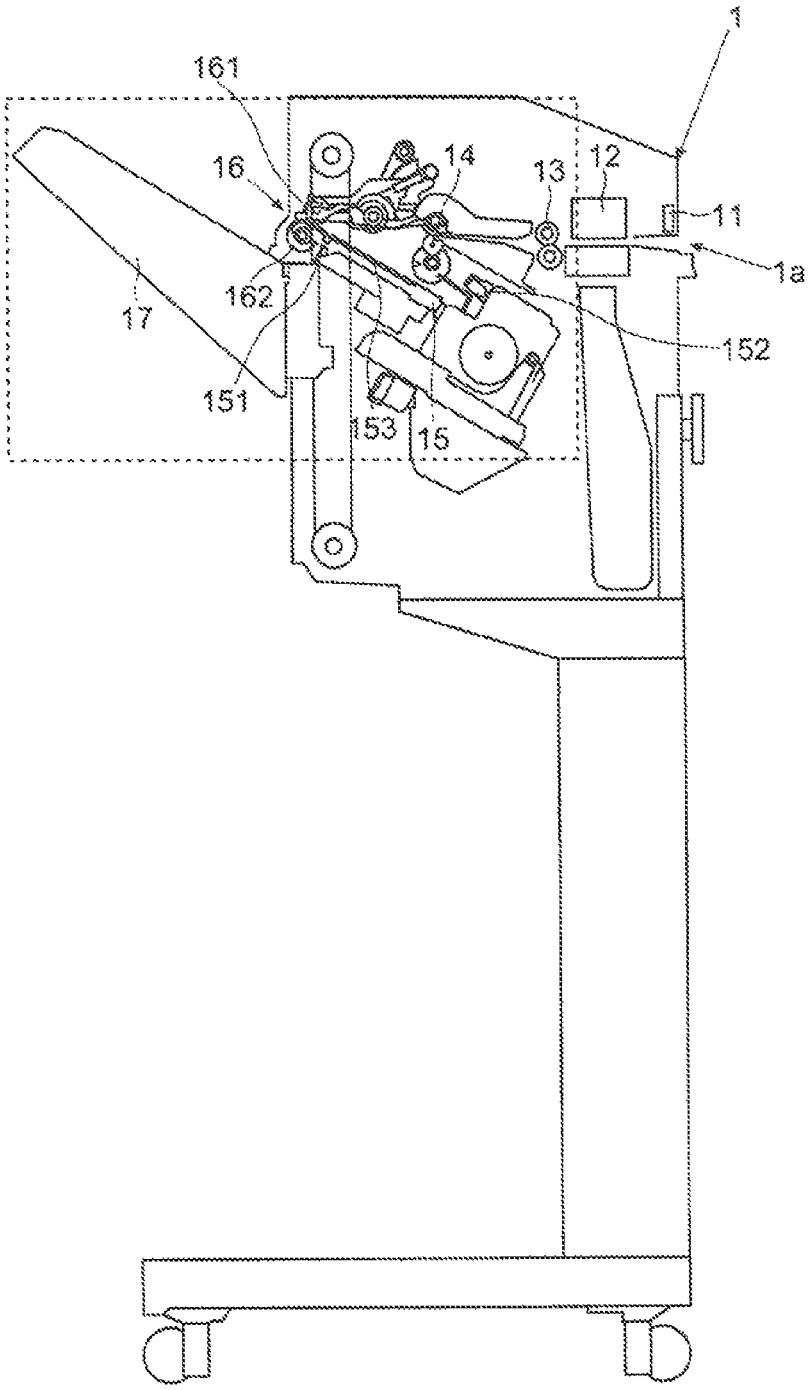
FIG. 2 is a diagram illustrating the configuration of a finisher according to an embodiment of the present disclosure.

Next, the finisher 1 according to an embodiment will be described with reference to FIG. 2. FIG. 2 is a diagram illustrating the configuration of the finisher 1 according to the present disclosure. The finisher 1 is a device that performs finishing on sheets on which images have been formed at the multifunctional peripheral 100.

The finisher 1 has an inlet la to receive sheets T discharged from the left side face of the multifunctional peripheral 100 and to send sheets T into the finisher 1. The inlet 1*a* is located at the upper portion of the right side face of the finisher 1. An intake sensor 11 to detect sheets T being sent into the finisher 1 is located near the inlet 1*a*. The intake sensor 11 includes an actuator and transmissive optical sensor. The output of the intake sensor 11 when there is a sheet which has reached the position of the intake sensor 11 or is passing through, and the output when there are no sheets T, are different. The intake sensor 11 is used to recognize the entrance of sheets T into the finisher 1.

The finisher 1 includes, in order from the inlet la along a feeding path for the sheets T, a puncher 12, a first conveying roller pair 13, a second conveying roller pair 14 serving as upstream side rollers, a processing tray 15, a discharge roller pair 16 serving as discharge rollers, and a discharge tray 17.

The puncher 12 punches holes in the sheets T, as one example of finishing. The puncher 12 performs the punching process on the sheets T when executing a printing job including settings being made by using the operating panel 3 to perform the punching process.

The first conveying roller pair 13 and second conveying roller pair 14 are located downstream from the puncher 12. The first conveying roller pair 13 and second conveying roller pair 14 rotate to feed the sheets T sent into the finisher 1 toward the processing tray 15 or discharge roller pair 16.

Sheets T to be stapled are temporarily loaded on the processing tray 15 as a bundle. In other words, sheets T before discharge to the discharge tray 17 can be temporarily loaded to the loading face of the processing tray 15. Also note that the processing tray 15 is tilted such that the downstream side in the feeding direction of sheets T is higher than the upstream side thereof.

The discharge roller pair 16 is provided at the downstream side of the processing tray 15 in the feeding direction of sheets T. The discharge roller pair 16 includes an upper roller 161 and lower roller 162. The upper roller 161 and lower roller 162 can rotate forward and backward, and thus can stack sheets T on the processing tray 15 and discharge sheets T to the discharge tray 17, which will be described later in detail. Note that here, the term "forward" means the direction of discharge of the sheets T to the discharge tray 17, and "backward" means the direction of returning the sheets T to the processing tray 15.

A discharge sensor 151 is provided nearby the discharge roller pair 16 at the downstream side of the processing tray 15 in the feeding direction of sheets T. The discharge sensor 151 is a detector to detect discharge of the sheets T, and is a reflective optical sensor. The output of the discharge sensor 151 when there is a sheet T which has reached the position of the discharge sensor 151 or is passing through, and the output when there is no sheet, are different. This discharge sensor 151 is used to recognize the arrival of sheets T to the position of the discharge sensor 151, and discharging of sheets T to the discharge tray 17.

Also, a stapler 152 is located above the upstream end of the processing tray 15 in the feeding direction of sheets T. The stapler 152 staples a bundle of sheets T loaded on the processing tray 15, as one example of finishing. The stapler 152 staples the bundle of sheets T when executing a printing job including settings being made by using the operating panel 3 to perform the stapling process.

The processing tray 15 also is provided with a pair of regulating guides 153 which position the sheets T in the width direction thereof, i.e., in the front-to-back direction of the finisher 1. The regulating guides 153 are moved by an alignment unit 19 (see FIG. 3) including a motor, gears, and so forth. The alignment unit 19 moves the regulating guides 153 in a direction perpendicular to the discharge direction of the bundle of sheets T in the finisher 1. Thus, the bundle of sheets T on the processing tray 15 is aligned in the width direction.

The discharge tray 17 is configured so as to be vertically movable. As the number of sheets T loaded on the discharge tray 17 increases, the discharge tray 17 moves downwards. Accordingly, the discharge of sheets T from the discharge roller pair 16 is not inhibited by sheets T already discharged onto the discharge tray 17, and thus a great number of sheets T can be loaded on the discharge tray 17.

Figure 3:
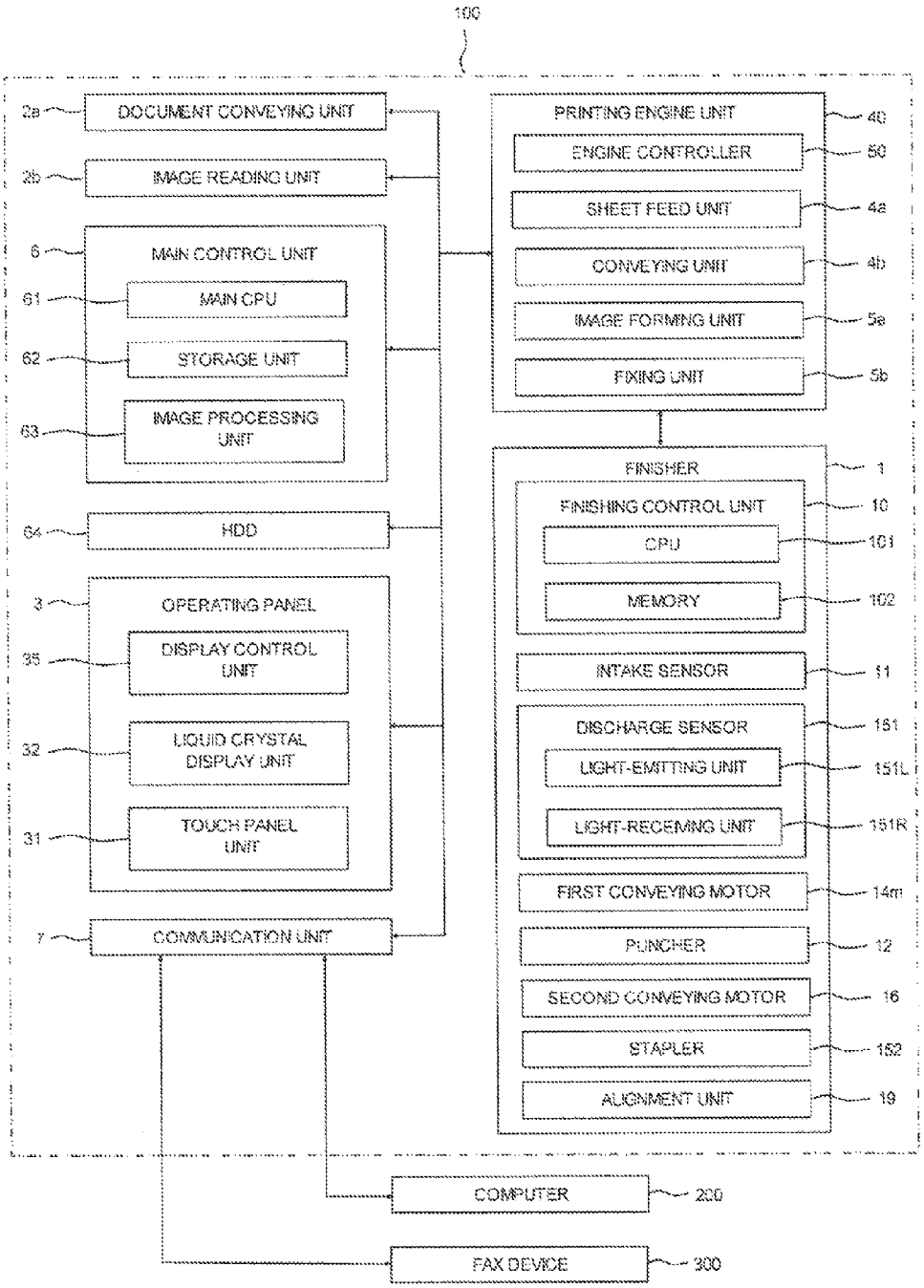
FIG. 3 is a block diagram illustrating the hardware configuration of the multifunctional peripheral.

Next, the hardware configuration of the multifunctional peripheral 100 including the finisher 1 will be described with reference to FIG. 3. FIG. 3 is a block diagram illustrating the hardware configuration of the multifunctional peripheral 100.

As illustrated in FIG. 3, the multifunctional peripheral 100 according to an embodiment has a main control unit 6 (control board) including various types of devices, circuits, and so forth. The main control unit 6 is communicably connected to a hard disk drive (HDD) 64, a communication unit 7 serving as an input unit, the document conveying unit 2*a*, image reading unit 2*b*, operating panel 3, and a printing engine unit 40 and so forth. The main control unit 6 communicates with these units to control the actions thereof, and also to obtain information therefrom.

The main control unit 6 includes a main central processing unit (CPU) 61, a storage unit 62, an image processing unit 63, and so forth. The main CPU 61 governs operations of the main control unit 6, and performs processing and control based on data and programs stored in the storage unit 62. The storage unit 62 is a combination of a non-volatile storage device (flash ROM) and a volatile storage device (e.g., RAM). The storage unit 62 stores data and programs used for various types of control, such as executing jobs and the like. An HDD 64 serving as a large-capacity storage device can be connected to the main control unit 6, so that the main control unit 6 can use the HDD 64 as one of the storage devices. The HDD 64 stores, image data and so forth, besides data and programs used for various types of control.

The image processing unit 63 subjects image data generated at the image reading unit 2*b* and eternally input images to image processing. The image processing unit 63 includes an application-specific integrated circuit (ASIC) dedicated to image processing, and memory, circuits, and the like for image processing. The image processing unit 63 can send image data after image processing to the exposing unit 53 for printing (copy function, printer function), or can store the image data in the HDD 64 (scanner function). Further, the image processing unit 63 can send image data after image processing to the computer 200 or a FAX device 300 or the like (scanner function, FAX function), from the later-described communication unit 7. Note that the main CPU 61 and storage unit 62 may functionally realize the image processing unit 63. Image processing which can be performed at the image processing unit 63 spans a great variety, such as enlarging/reducing processing, altering density, and so forth, so detailed description thereof will be omitted, since known image process can be implemented.

The main control unit 6 is connected with the communication unit 7. The communication unit 7 is an interface for communicating with an external computer 200 (e.g., personal computer or server) or FAX device 300 via networks, lines, cables or the like. Accordingly, the communication unit 7 includes various types of connectors, communication circuits, devices, controllers, modem circuits, and so forth. The main control unit 6 can receive printing data (image data and settings data) from the external computer 200 and FAX device 300, and can transmit image data to the external computer 200 and FAX device 300, by way of communication via the communication unit 7.

The operating panel 3 is provided for settings input and display regarding the multifunctional peripheral 100. The operating panel 3 includes therein a display control unit 35 which accepts the instructions of the main control unit 6 to control operations of the operating panel 3. The display control unit 35 includes a CPU, memory, and various types of circuits. The display control unit 35 recognizes operations made at the operating panel 3 and controls display made in response to operations, such as display control at the liquid crystal display unit 32, recognition of coordinates of positions and keys pressed on the touch panel unit 31, operation of the hard keys such as the numerical keypad 33 and start key 34, and so forth.

The multifunctional peripheral 100 includes the printing engine unit 40, which performs printing. The printing engine unit 40 includes the above-described sheet feed unit 4*a*, conveying unit 4*b*, image forming unit 5*a*, and fixing unit 5*b*. The printing engine unit 40 has therein an engine controller 50 which controls operations of the parts of the printing engine unit 40 under instructions from the main control unit 6. The engine controller 50 includes a CPU, memory, and so forth. The engine controller 50 controls sheet feeding and conveying, toner image formation, temperature control of the fixing unit 5*b*, and so on, performed by the parts included in the printing engine unit 40.

Also, the engine controller 50 of the printing engine unit 40 relays operation instructions from the main control unit 6 so as to give the finisher 1 operation instructions. The engine controller 50 of the printing engine unit 40 can also give operation instructions to the finisher 1. The engine controller 50 performs overall control relating to printing, and the finisher 1 is subject to the printing engine unit 40 (engine controller 50).

The finisher 1 has therein a finishing control unit 10 serving as a recognizing unit to control the operations of the finisher 1 under instructions from the engine controller 50. The finishing control unit 10 includes a CPU 101, memory 102, and so forth. The finishing control unit 10 detects sheets T sent into the finisher 1 and the sheets T passing the position where the intake sensor 11 is installed, from the output of the intake sensor 11.

The output of the discharge sensor 151 is inputted to the finishing control unit 10. The finishing control unit 10 detects whether or not a sheet T exists at the position where the discharge sensor 151 is installed, from the magnitude of output (output level) of the discharge sensor 151 which the finishing control unit 10 receives.

The finishing control unit 10 also controls rotation of a first conveying motor 14*m* which rotates the first conveying roller pair 13 and second conveying roller pair 14. Upon the intake sensor 11 detecting a sheet T being carried in, the finishing control unit 10 drives the first conveying motor 14*m* to rotate the first conveying roller pair 13 and second conveying roller pair 14 at least until the trailing end of the sheet T passes the second conveying roller pair 14 (until the sheet T is conveyed past the second conveying roller pair 14).

The finishing control unit 10 also controls the actions of the puncher 12 and stapler 152. For printing jobs having settings made by using the operating panel 3 to perform punching, the finishing control unit 10 causes the puncher 12 to perform a punching process on the sheets T. Also, for printing jobs having settings made by using the operating panel 3 to perform stapling, the finishing control unit 10 causes the stapler 152 to staple a bundle of the sheets T loaded on the processing tray 15. When the sheets T are loaded on the processing tray 15 for the stapling process, the finishing control unit 10 causes the alignment unit 19 to operate, so as to align the bundle of sheets T. The finishing control unit 10 further controls the discharge roller pair 16 by controlling operations of a second conveying motor 16*m* which rotates the discharge roller pair 16.

Figure 4:
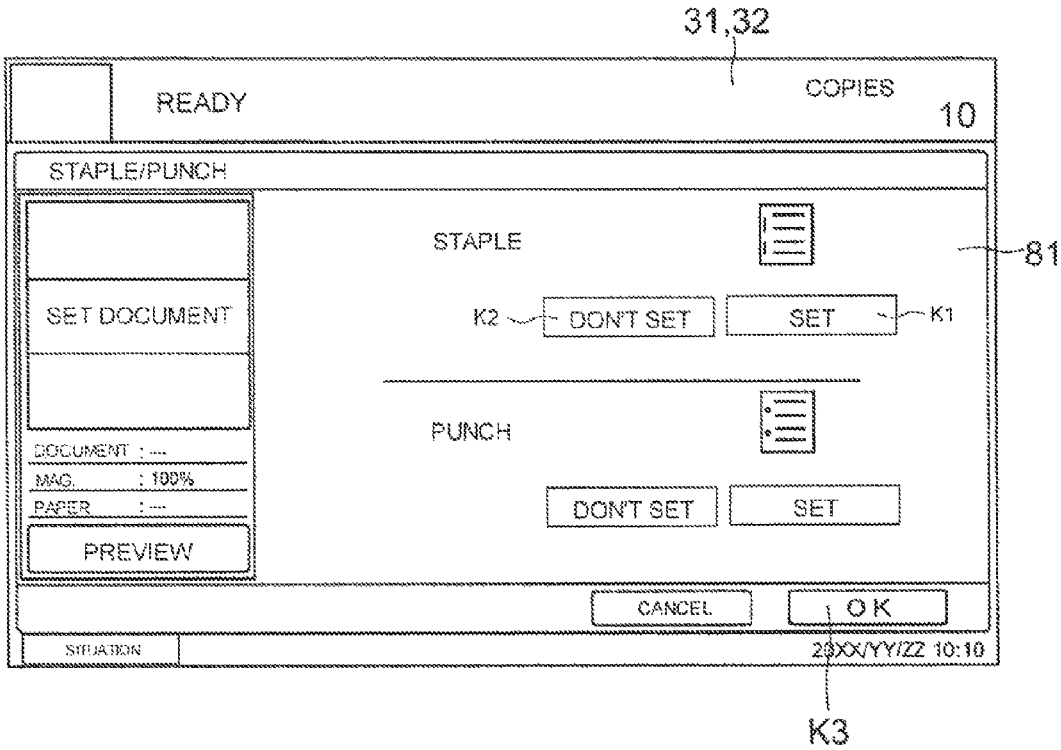
FIG. 4 is a diagram illustrating a setting screen on an operating panel, relating to usage of the finisher.

Next, settings of the finisher 1 according to an embodiment will be described with reference to FIG. 4. FIG. 4 is a diagram illustrating a settings screen 81 on the operating panel 3, relating to usage of the finisher 1.

As described above, the multifunctional peripheral 100 can cause the finisher 1 to staple and punch. More specifically, the user can operate the operating panel 3 to display the settings screen 81 for setting a stapling process and a punching process, on the liquid crystal display unit 32. The settings screen 81 enables the user to set whether or not to cause the finishing control unit 10 to staple , which includes whether or not to load the sheets T on the processing tray 15 in increments of copies and then discharge, and whether or not to punch.

The user presses a stapling execution key K1 displaying "set" in a case of causing the finisher 1 to perform stapling. On the other hand, the user presses a stapling non-execution key K2 displaying "don't set" in a case of not performing stapling.

When an OK key K3 is pressed with the stapling execution key K1 pressed, the operating panel 3 notifies the main control unit 6 that stapling is to be performed. When the printing job is started with stapling having been set, the main control unit 6 informs the finishing control unit 10 via the engine controller 50 that stapling is to be executed. Thus, the finishing control unit 10 recognizes that the sheets T should be loaded on the processing tray 15 and stapling should be performed.

On the other hand, when the OK key is pressed with the stapling non-execution key K2 pressed, the operating panel 3 notifies the main control unit 6 that stapling will not to be performed, and sheets T will not be loaded on the processing tray 15. Default settings are settings where executing stapling is not set. When the printing job is started with not performing stapling having been set, the main control unit 6 informs the finishing control unit 10 via the engine controller 50 that no stapling is to be executed when printing. Thus, the finishing control unit 10 recognizes that the sheets T should be discharged to the discharge tray 17 without being loaded on the processing tray 15, as with normal discharging process of the sheets T.

Figure 5:
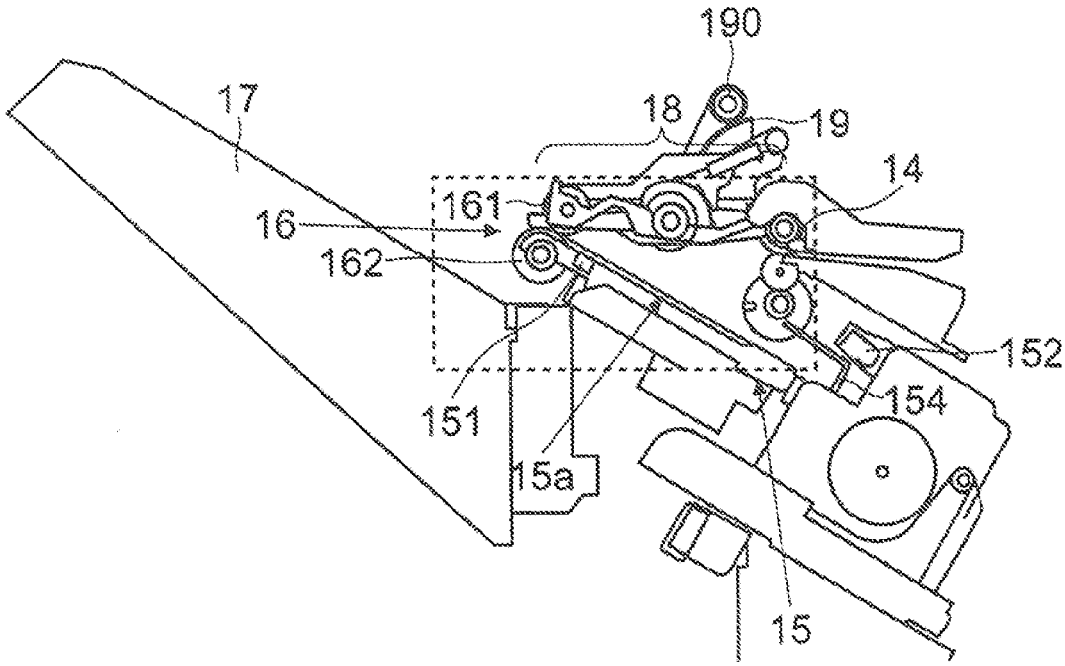
FIG. 5 is a diagram illustrating a state in which an upper roller and lower roller are in contact.

Next, normal discharging process of sheets T in the finisher 1 according to an embodiment will be described with reference to FIG. 5. FIG. 5 is a diagram illustrating when the upper roller 161 and lower roller 162 are in contact. Note that FIG. 5 is an enlarged diagram of the portion surrounded by dotted lines in FIG. 2.

First, with the finisher 1 according to an embodiment, an arm unit 18 is vertically movable. The upper roller 161 of the discharge roller pair 16 is attached to the arm unit 18, as well as other structures, which will be described in detail later. The arm unit 18 is fixed at a position where the upper roller 161 and lower roller 162 are in contact in the case of normal discharging process, as illustrated in FIG. 5.

Thus, sheets T are discharged to the discharge tray 17 without being loaded on the processing tray 15 when stapling is not performed. Specifically, the sheets T are discharged to the discharge tray 17 according to normal discharging process in the case of printing jobs where neither punching nor stapling is to be performed, and printing jobs where punching is performed and stapling is not performed.

When performing normal discharging process, the finishing control unit 10 causes the second conveying motor 16*m* to rotate, so that the discharge roller pair 16 made up of the upper roller 161 and lower roller 162 rotate in the forward direction, that is, in the direction to discharge the sheets T to the discharge tray 17. Accordingly, the discharge roller pair 16 discharge the sheets T arriving at the discharge roller pair 16 from the second conveying roller pair 14 toward the discharge tray 17. In other words, when not performing stapling using the processing tray 15, the rollers of the discharge roller pair 16 continuously discharge the sheets T to the discharge tray 17.

Figure 6:
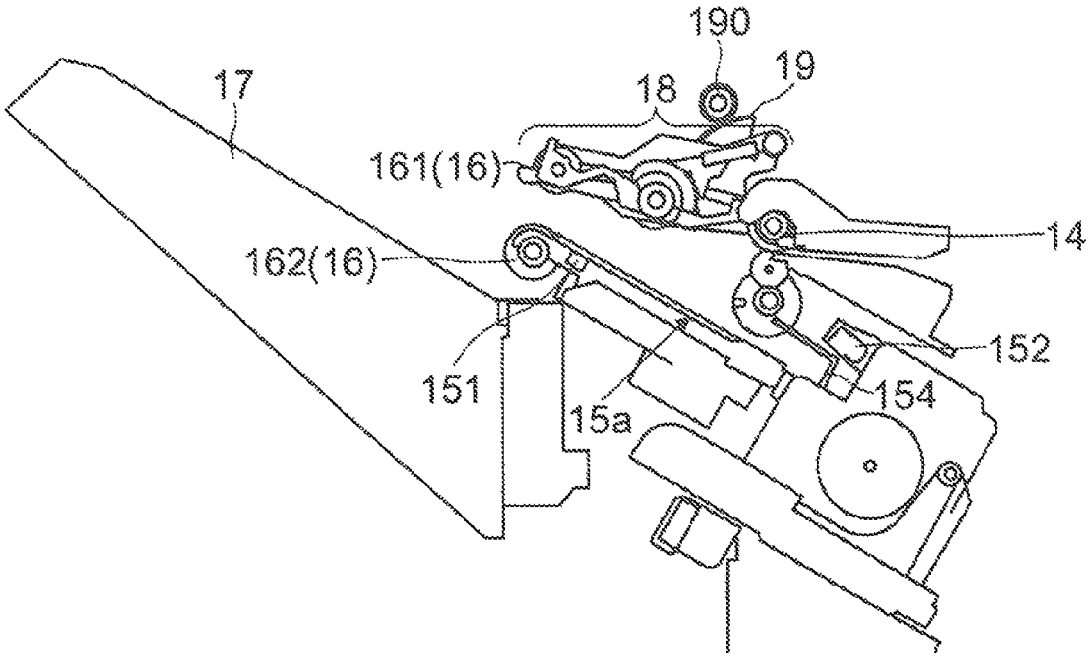
FIG. 6 is a diagram illustrating a state in which the upper roller and lower roller are separated.

Next, operations when performing stapling will be described with reference to FIGS. 5 and 6. FIG. 6 illustrates when the upper roller 161 and lower roller 162 are separated. Note that FIG. 6 also is an enlarged diagram of the portion surrounded by dotted lines in FIG. 2.

When loading the sheets T on the processing tray 15 for stapling, the finishing control unit 10 moves the arm unit 18 upwards until stapling is completed, so that the upper roller 161 and the lower roller 162 are in a separated state. That is to say, the formation of the nip by the upper roller 161 and lower roller 162 is released.

The upper roller 161 is attached to the left end portion of the arm unit 18. Also, a gear portion 19 is provided on the upper side of the arm unit 18 so as to move the arm unit 18 vertically. A gear tooth face is provided on the gear portion 19. A gear shaft 190 is provided above the gear portion 19 and arm unit 18, so as to mesh with the gear portion 19. Rotation of the gear shaft 190 causes the arm unit 18 to be moved upwards or downwards, with the upper side roller of the second conveying roller pair 14 serving as a fulcrum, such that the upper roller 161 and lower roller 162 are separated or brought into contact.

A motor may be provided to move the arm unit 18 vertically, or the driving force of the second conveying motor 16*m* may be transmitted to the gear shaft 190. Upon driving the second conveying motor 16*m* in the forward direction (the rotational direction by which the upper roller 161 and lower roller 162 discharge the sheets T to the discharge tray 17), the gear shaft 190 rotates in the direction by which the upper roller 161 and lower roller 162 come into contact. Thus, the arm unit 18 descends. On the other hand, upon driving the second conveying motor 16*m* in the backward direction, the gear shaft 190 rotates in the direction by which the upper roller 161 and lower roller 162 are separated. Thus, the arm unit 18 rises.

The finishing control unit 10 keeps the arm unit 18 in a raised state until the first page through the last page of the bundle (copy) of sheets T to be stapled pass through the second conveying roller pair 14, with the upper roller 161 and lower roller 162 in a separated state.

There is a space between the upper roller 161 and the lower roller 162, so the leading end of a sheet T being fed by the second conveying roller pair 14 passes between the upper roller 161 and the lower roller 162. The sheet T is then fed downward toward the processing tray 15 by a feeding member (not illustrated) provided within the arm unit 18. The feeding member is, for example, a paddle or roller which rotates in the direction of feeding the sheet T in the direction toward the lower right of the processing tray 15 and comes into contact with the uppermost sheet T, a guide plate which moves in the direction of slapping the sheet T down in the direction toward the lower right of the processing tray 15, or the like.

The sheet T is fed in the direction toward the lower right of the processing tray 15 under its own weight and/or by the feeding member. The processing tray 15 includes a stopper 154, to receive the end portion of sheets T at the lower right side, loaded on the processing tray 15. The lower ends of the sheets T abut the stopper 154. The sheets T are loaded on the processing tray 15 while being aligned in the longitudinal direction (conveying direction of the sheets T) by the feeding member and the stopper 154. Note that the bundle of sheets T is gradually loaded on the processing tray 15 with a part of the leading end of the sheets T (discharge tray 17 side) protruding toward the discharge tray 17 side from between the upper roller 161 and lower roller 162.

Finally, when the necessary number of sheets T to perform the stapling process (one copy) are loaded on the processing tray 15, the finishing control unit 10 causes the stapler 152 to perform stapling.

The finishing control unit 10 moves the arm unit 18 in the direction whereby the upper roller 161 of the discharge roller pair 16 come into contact (lower direction) with lower roller 162 to discharge the bundle of sheets T after stapling to the discharge tray 17. Specifically, The finishing control unit 10 causes the second conveying motor 16*m* to rotate forwards, causing the gear shaft 190 to rotate, and moving the arm unit 18 in the direction toward the processing tray 15, i.e., in the direction whereby the upper roller 161 comes closer to the lower roller 162.

Accordingly, the discharge roller pair 16 made up of the upper roller 161 and lower roller 162 nip the bundle of sheets T that have been subjected to stapling. The finishing control unit 10 continues to rotate the second conveying motor 16*m* in the direction of discharging the bundle of sheets T to the discharge tray 17 (forward direction). In other words, the finishing control unit 10 rotates the discharge roller pair 16 in the direction where the bundle of sheets T will be fed to the discharge tray 17. If further stapling is to be performed, the finishing control unit 10 moves the arm unit 18 upwards, so as to separate the upper roller 161 and lower roller 162.

Figure 7:
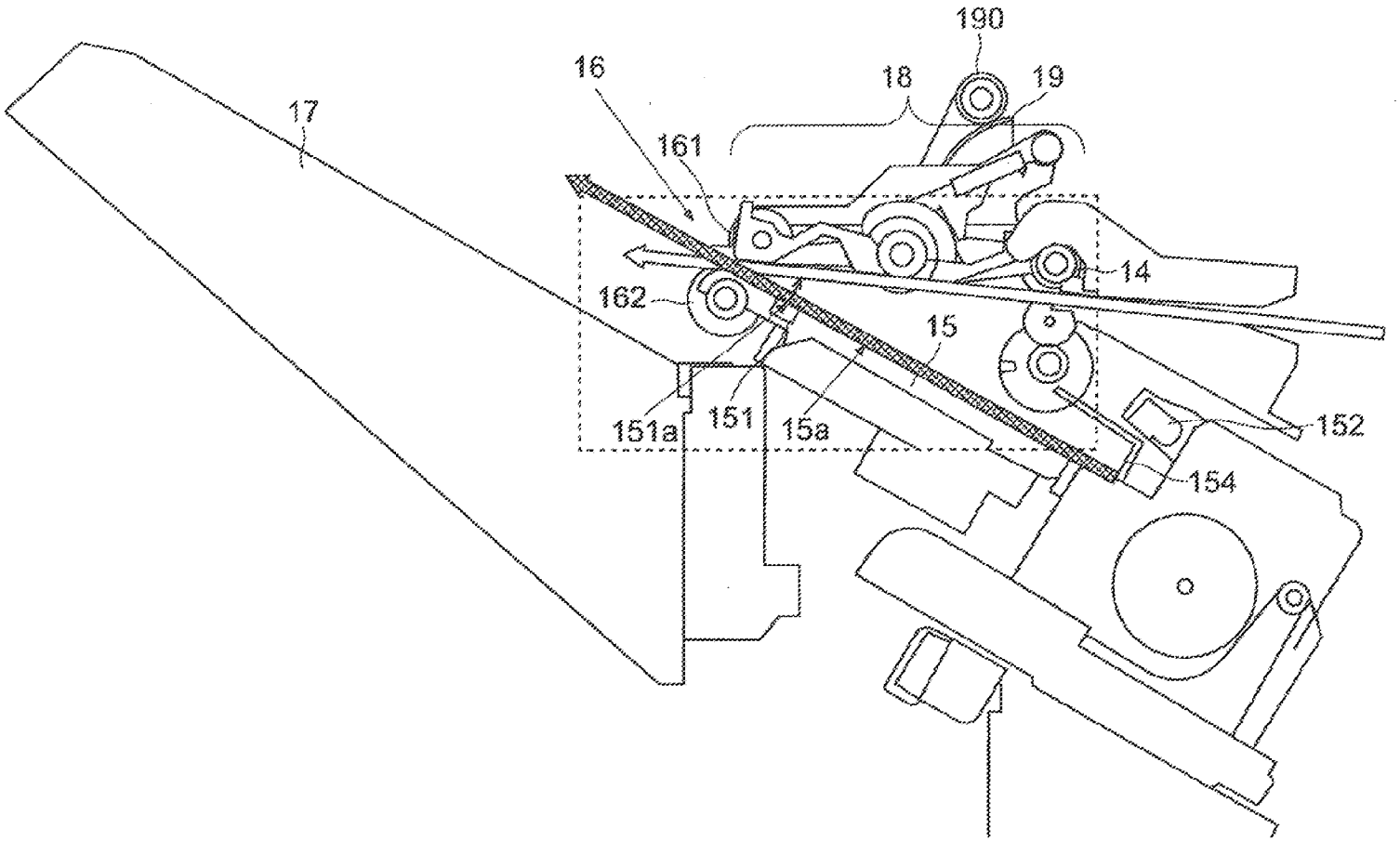
FIG. 7 is a diagram for describing a sheet discharge direction.
Figure 8:
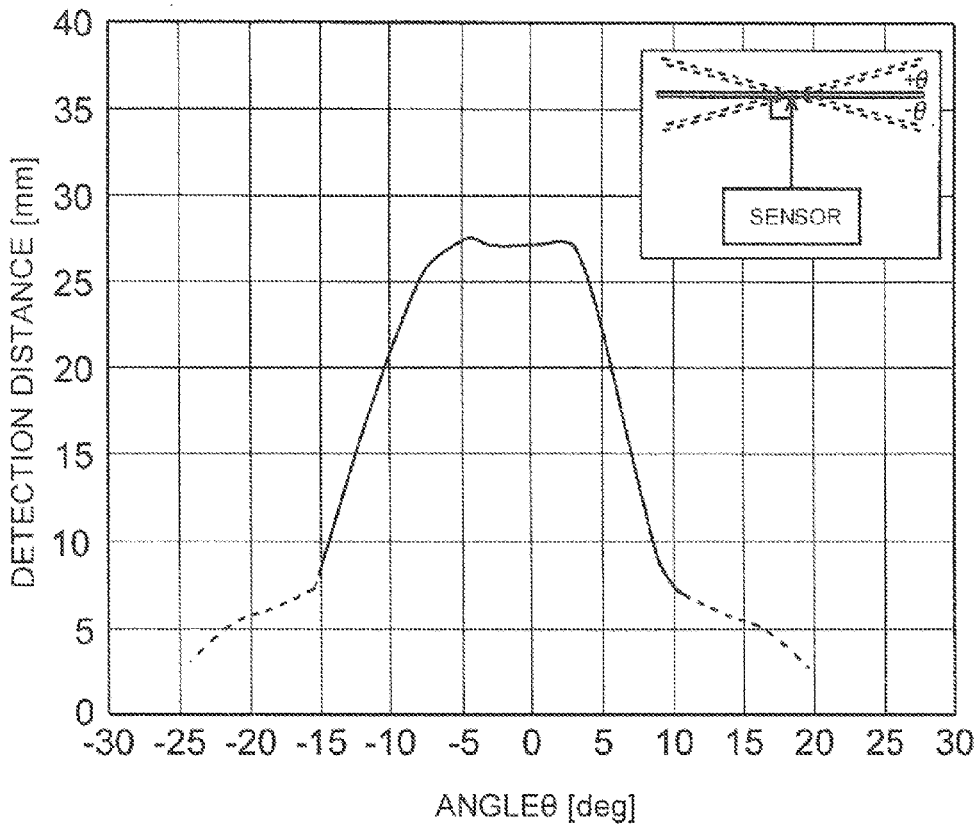
FIG. 8 is a graph illustrating detection properties of a discharge sensor.

Next, detection of sheets T by the discharge sensor 151, and the direction of discharge of the sheets T, will be described with reference to FIGS. 7 and 8. FIG. 7 is a diagram for describing the discharge direction of sheets T, and FIG. 8 is a graph illustrating detection properties of the discharge sensor 151.

The discharge sensor 151 is provided to the finisher 1 according to an embodiment between the discharge roller pair 16 and second conveying roller pair 14. Specifically, the discharge sensor 151 is located on a sheet loading face 15*a* of the processing tray 15. The discharge sensor 151 detects the arrival of sheets T and discharge of sheets T to the discharge tray 17. Accordingly, the discharge sensor 151 is located near the lower roller 162.

The discharge sensor 151 is a reflective optical sensor. The discharge sensor 151 is located at a position where the space between the arm unit 18 and the processing tray 15 is narrow, since the discharge sensor 151 is preferably installed as close to the discharge roller pair 16 as possible. Thus, a reflective optical sensor is used for the discharge sensor 151 instead of a transmissive optical sensor, due to structural considerations such as little space to install a rotating actuator.

The discharge sensor 151 includes a light-emitting unit 151L made up of a light-emitting element such as an LED, and a light-receiving unit 151R made up of a photoreceptor such as a phototransistor or a photodiode (see FIG. 3). The discharge sensor 151 emits light from a detecting face 151*a*, and receives light reflected off of the sheets T. The output of the discharge sensor 151 is inputted to the finishing control unit 10. The finishing control unit 10 detects whether or not there is a sheet T in the detection region of the discharge sensor 151 (installation point) based on the output of the discharge sensor 151. The finishing control unit 10 detects whether or not there is a sheet T based on whether the output level of the discharge sensor 151 is high or low (whether or not the output of the light-receiving unit 151R of the discharge sensor 151 is at or above a threshold value).

The processing tray 15 is inclined, as illustrated in FIG. 7. Accordingly, the discharge sensor 151 and the detecting face 151*a* thereof also are inclined. Thus, as indicated by solid line in FIG. 7, the discharge sensor 151 emits light in a direction toward the upper right when viewed from the front of the discharge sensor 151. In other words, the optical axis of the discharge sensor 151 is inclined toward the upper right.

The hollowed arrow in FIG. 7 illustrates the conveying path of the sheets T during normal discharging process. On the other hand, the hatched arrow illustrates the conveying path of the sheets T from the processing tray 15 when performing a stapling process.

Now, the detection properties of the discharge sensor 151, which is the reflective optical sensor according to an embodiment, will be described. The horizontal axis in the graph in FIG. 8 represents the magnitude of inclination (angle) of the sheets T from the perpendicular direction with respect to the optical axis of the discharge sensor 151. That is to say, when the angle of the sheets T with respect to the optical axis is 90 degrees corresponds to 0 degrees in the graph. The discharge sensor 151 according to an embodiment emits light at a 90-degree angle with respect to the detecting face 151*a*, so if the detecting face 151*a* and the sheets T are parallel, the angle is 0 degree. Also, the vertical axis in the graph in FIG. 8 represents the detection distance from the detecting face 151*a* of the discharge sensor 151 to the sheets T at which the discharge sensor 151 can detect the presence of the sheets T.

The graph in FIG. 8 plots the relation between the inclination of the sheets T with respect to the discharge sensor 151 and the detection distance by a solid line, when detecting OHP sheets T. The greater the angle of the sheets T with respect to the optical axis of the discharge sensor 151 deviates from 90 degrees, the shorter the distance between the detecting face 151*a* and the sheets T where the OHP sheets T can be detected is, as illustrated in FIG. 8. It can be seen in the example in FIG. 8 that when the angle of the conveying path of the sheets T (conveying attitude and conveying direction) deviates around ±12 to 13 degrees from the state of 90 degrees, the detection distance becomes short, and erroneous detection readily occurs.

For example, the greater the deviation is, that is to say, the greater the inclination of sheets T is from 90 degrees, the more readily the finishing control unit 10 will detect that there are no sheets T, even when there are sheets T present at the detection region of the discharge sensor 151. Also, when the output of the light-receiving unit 151R of the discharge sensor 151 is around a threshold value, depending on the inclination of the sheets T with respect to the optical axis of the discharge sensor 151, the finishing control unit 10 will intermittently repeat detection that there are sheets T and detection of no sheets T in short cycles. While FIG. 8 is an example of OHP sheets T, the greater the deviation of the conveying path of the sheets T is from 90 degrees with respect to the optical axis of the discharge sensor 151, the more readily erroneous detection occurs, since reflective optical sensors receive reflected light from the sheets T.

Thus, if the sheets T are inclined from the perpendicular direction with respect to the optical axis of the discharge sensor 151, there are situations where the finishing control unit 10 erroneously detects that the sheets T have been discharged, even though the sheets T have not been discharged, that is to say the trailing end of the sheets T has not passed the discharge sensor 151. Alternatively, a situation can be conceived where the finishing control unit 10 erroneously detects that the sheets T have not yet arrived, even though the sheets T have already arrived at the installation position of the discharge sensor 151. Occurrence of erroneous detection may render suitable control of feeding of the sheets T impossible.

For example, the finishing control unit 10 according to an embodiment recognizes the occurrence of a jam using the discharge sensor 151. The finishing control unit 10 detects a jam of the sheets T in a situation where the arrival of sheets T is not detected by using the discharge sensor 151 within a predetermined time to detect the arrival of the sheets T after having detected the sheets T by using the intake sensor 11, or where passage of sheets T, that is to say discharging of sheets T, is not detected by using the discharge sensor 151 within a predetermined time to detect the passage of sheets T. Once a jam is detected, the finishing control unit 10 stops the motors to stop feeding of the sheets T. Thus, feeding of the sheets T is meaninglessly stopped due to erroneous detection.

In the situation of a stapling process, the distance between the sheets T and discharge sensor 151 is short, since the sheets T are loaded on the processing tray 15 as illustrated in FIG. 7. Also, the conveying path of the sheets T with respect to the optical axis of the discharge sensor 151 is approximately 90 degrees. Accordingly, in a situation of loading OHP sheets T on the processing tray 15, there is basically no erroneous detection of whether or not there are sheets T by using the discharge sensor 151.

However, OHP sheets T are usually not stapled. Accordingly, the OHP sheets T are discharged by normal discharge process. Conventionally, the conveying path for normal discharge process is inclined from a perpendicular direction with respect to the optical axis of the discharge sensor 151, as illustrated in FIG. 7. Accordingly, simply performing normal discharge process of OHP sheets T may result in erroneous detection of whether or not there are OHP sheets T.

Accordingly, the finisher 1 according to an embodiment discharges the sheets T in a bent state, using the discharge roller pair 16 when performing normal discharge process.

Figure 9:
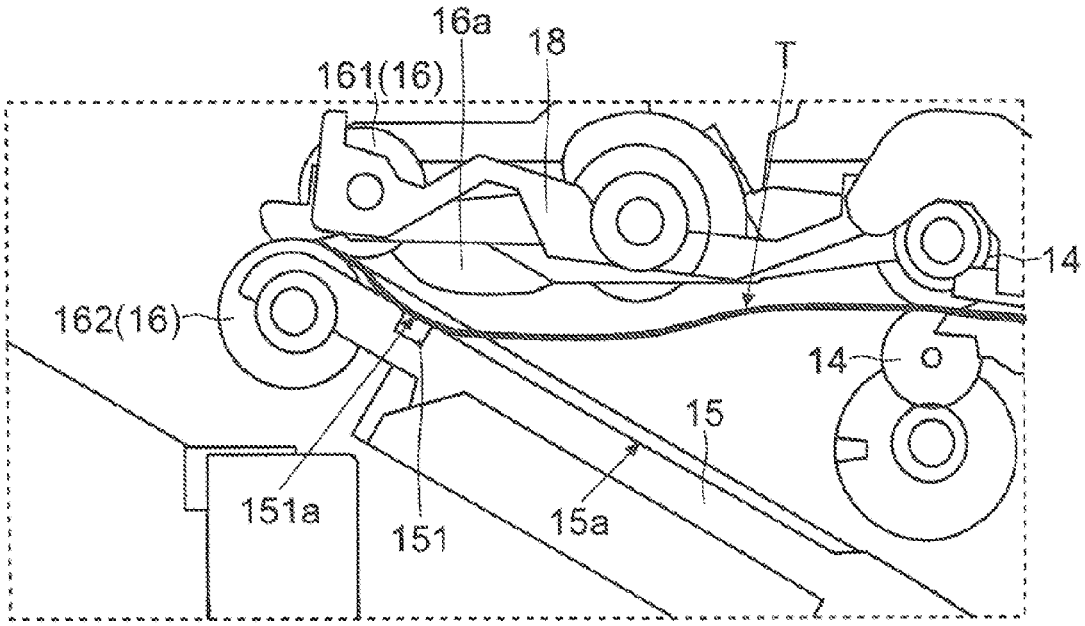
FIG. 9 is a diagram for describing conveyance of sheets during normal discharging.

Next, conveying of sheets T for normal discharge process with the finisher 1 according to an embodiment will be described with reference to FIG. 9. FIG. 9 is a diagram for describing feeding of sheets T during normal discharge process. Note that FIG. 9 is an enlarged diagram of the portion surrounded by dotted lines in FIG. 5. The heavy line in FIG. 9 represents a sheet T.

When performing normal discharging process, the finishing control unit 10 causes the discharge roller pair 16 to feed the sheet T so as to be bent as described above. This bending is performed such that the sheet T comes closer to the discharge sensor 151 between the second conveying roller pair 14 and discharge roller pair 16, or such that the sheet T comes close to being perpendicular to the optical axis of the discharge sensor 151. In other words, the finishing control unit 10 uses the discharge roller pair 16 to form a bending.

Specifically, the finishing control unit 10 may reduce the sheet feeding speed of the discharge roller pair 16 as compared to that of the second conveying roller pair 14 to form the bending. In other words, the finishing control unit 10 rotates the first conveying motor 14*m* and the second conveying motor 16*m* such that the circumferential speed of the discharge roller pair 16 is slower than that of the second conveying roller pair 14.

Alternatively, the finishing control unit 10 may start rotating the discharge roller pair 16 after a bending formation time to form the bending, which is the time required for the bending of the sheet T to reach a predetermined bend, elapses after the sheet T has abutted the discharge roller pair 16. In other words, the finishing control unit 10 rotates the second conveying motor 16*m* forward after elapsing of the bending formation time from the sheet T abutting the discharge roller pair 16. Now, the sheet feeding speed by the first conveying roller pair 13 and second conveying roller pair 14 is constant. Accordingly, the finishing control unit 10 starts rotating the discharge roller pair 16 at a point when time necessary to contact the sheet T with the discharge roller pair 16 and time necessary to band the sheet T (bending formation time) elapses from detection of the leading end of the sheet T arriving at the intake sensor 11. In this situation, the bending amount is constant, and the sheet T is not bent any more than necessary. Alternatively, the finishing control unit 10 may rotate the second conveying motor 16*m* forward when the discharge sensor 151 detects the presence of a sheet.

The discharge roller pair 16 feeds the sheet T which is being bent so as to come into contact with the detection face 151*a* of the discharge sensor 151. The positional relation and installation angle of the discharge roller pair 16 and second conveying roller pair 14, and the arm unit 18, serve as pressing members from above to restrict the bending direction of the sheet T, so that the sheet T bends to come close to the detecting face 151*a* of the discharge sensor 151, or so as to approximate being perpendicular to the optical axis of the discharge sensor 151. Accordingly, even in the situation of OHP sheets, the finishing control unit 10 can detect the presence of the OHP sheets T, and arrival of the leading end and passage of the trailing end thereof, using the discharge sensor 151.

Note that a bending guide 16*a* which guides the bending direction of the sheet T may be provided, to bend the sheet T to come into contact with the detection face 151*a* of the discharge sensor 151. The bending guide 16*a* is provided at a position above the discharge sensor 151 nearby the upper roller 161, and has a form curved downwards. Thus, sheets T such as OHP sheets T can be bent to come into contact with the detection face 151*a* of the discharge sensor 151 in a sure manner.

Figure 10:
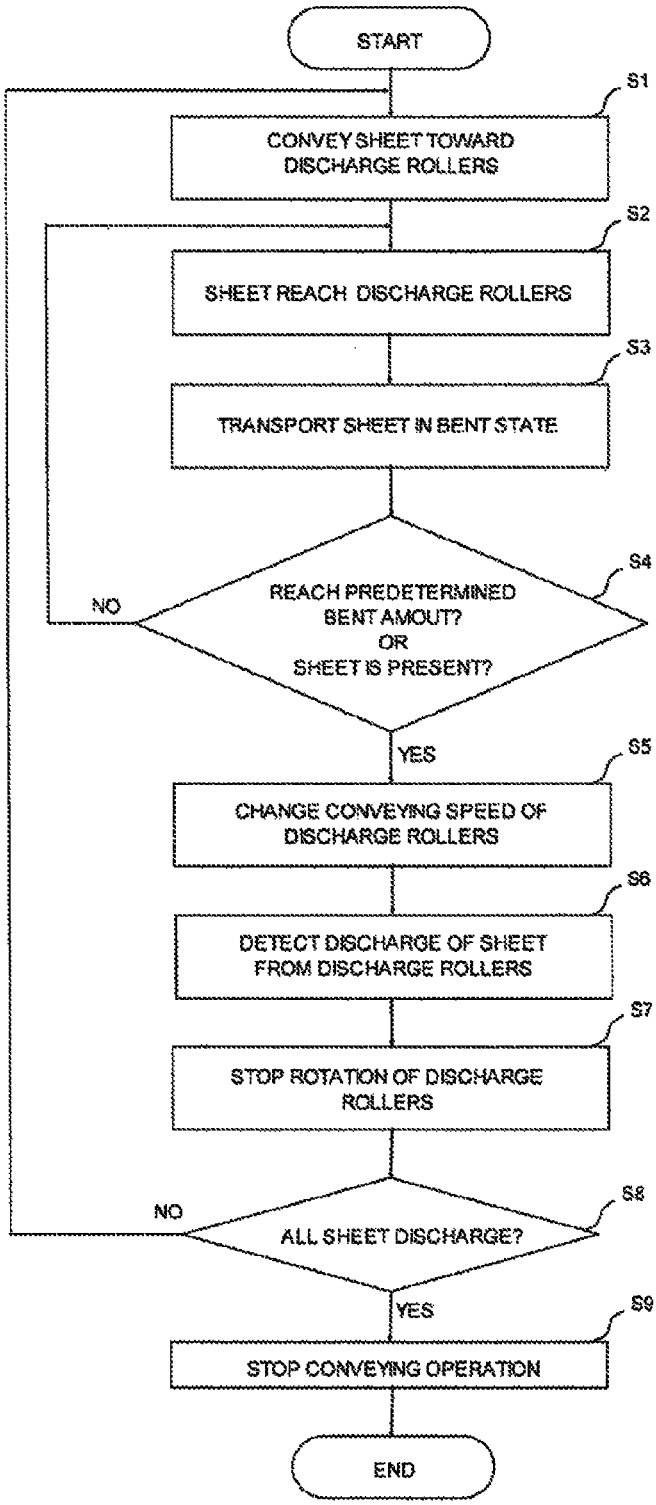
FIG. 10 is a flowchart illustrating the flow of operations during normal discharging.
Figure 11:
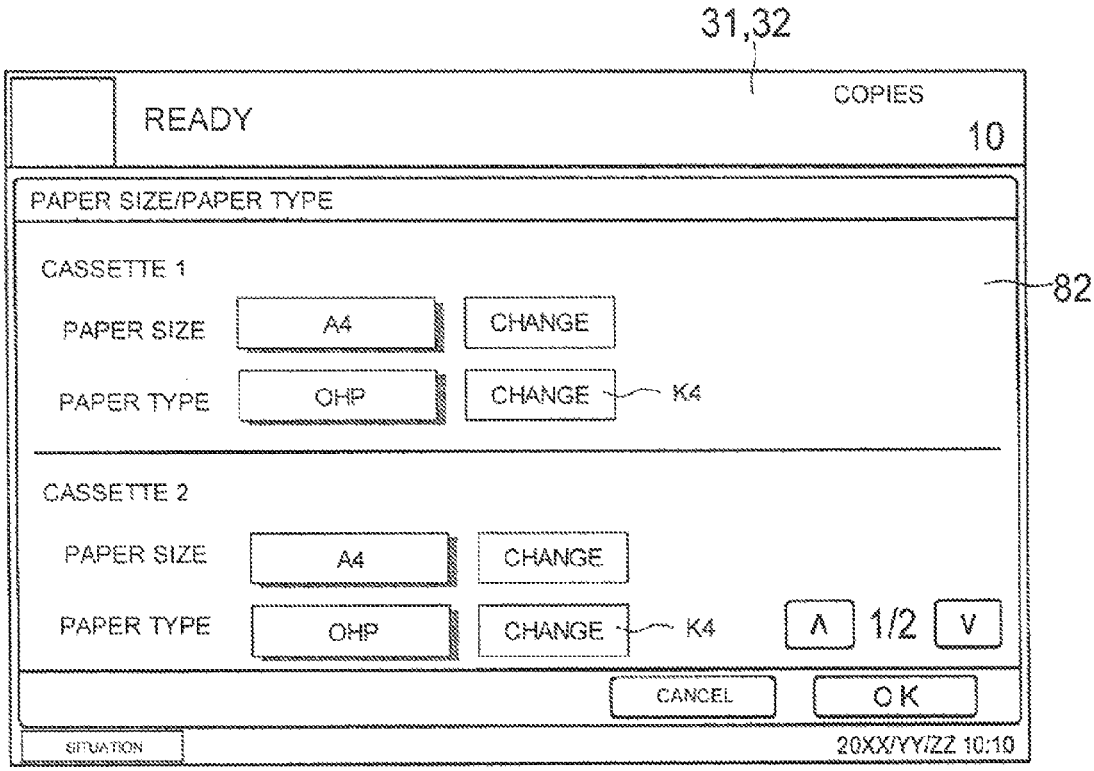
FIG. 11 is a diagram illustrating a setting screen to set the type of sheet to use.

Next, the flow of processing performed in normal discharging process will be described with reference to FIGS. 10 and 11. FIG. 10 is a flowchart illustrating the flow of actions during normal discharging process, and FIG. 11 is a diagram illustrating a settings screen 82 to set the type of sheet T to use.

The start of FIG. 10 is the point that a first sheet T, of a printing job executed under settings that normal discharging process is to be performed, reaches the inlet 1*a* of the finisher 1. In other words, this is the point where the finishing control unit 10 detects, by way of the intake sensor 11, that the first sheet T, of the job executed under settings that a stapling process will not be performed, has arrived at the inlet la of the finisher 1. Note that when discharging sheets T to the discharge tray 17 after loading the sheets T on the processing tray 15 and performing a stapling process, the finishing control unit 10 causes the discharge roller pair 16 to feed the sheets T without bending the sheets T between the second conveying roller pair 14 and discharge roller pair 16.

Upon a sheet T being sent into the finisher 1 from the inlet la, the finishing control unit 10 rotates the first conveying motor 14*m* (step S1). Thus, the first conveying roller pair 13 and second conveying roller pair 14 rotate, and the sheet T is fed by the first conveying roller pair 13 and second conveying roller pair 14 toward the discharge roller pair 16. Note that the first conveying motor 14*m* continues to rotate until all of the sheets T of the printing job are discharged. Also, if settings to perform punching have been made, the finishing control unit 10 causes the puncher 12 to perform punching on the sheets T passing by.

Next, the leading end of the sheet T reaches the discharge roller pair 16 (step S2). It is sufficient for the finishing control unit 10 to determine that the leading end of the sheet T has reached the discharge roller pair 16 after the leading end of the sheet T arriving is detected using the intake sensor 11, time necessary for the sheet T to be fed by using the first conveying roller pair 13 and second conveying roller pair 14 to the discharge roller pair 16 elapses.

The finishing control unit 10 then creates a difference between the rotational speed of the discharge roller pair 16 and that of the second conveying roller pair 14, so that the sheet T is transported in a bent state (step S3). In this situation, the rotation of the discharge roller pair 16 may be started after the sheet T bends, or the sheet feeding speed of the discharge roller pair 16 may be slower than that of the second conveying roller pair 14, as described above.

Now, there are situations where the finishing control unit 10 can accurately detect whether sheets T are present or absent based on the output of the discharge sensor 151 even without bending the sheets. This includes situations where sheets T which are white like plain paper or copier paper, and without being passed through by light like OHP sheets. Accordingly, an arrangement may be made where sheets T are fed by the discharge roller pair 16 being bent between the discharge roller pair 16 and second conveying roller pair 14 when the finishing control unit 10 receives operation made at the operating panel 3 that the type of sheets T is OHP sheets T. In this situation, the operating panel 3 functions as an input unit for setting operations of the finisher 1. Alternatively, input buttons and panel may be provided separately in the finisher 1.

Now, settings relating to sheets T stored in each cassette 41 of the multifunctional peripheral 100 will be described with reference to FIG. 11. Operating the operating panel 3 enables the user to display a sheet settings screen 82 such as illustrated in FIG. 11 on the liquid crystal display unit 32.

The user can perform settings relating to sheets T stored in each of the cassettes 41 by using the sheet settings screen 82. The size and type of sheets T currently set is displayed for each cassette 41 on the sheet settings screen 82. Changing keys K4 are provided for the display spaces of the setting values for the current type of sheets T (plain paper and OHP sheets T are illustrated in the example in FIG. 11). Touching the display position of the changing key K4 displays multiple keys to set the type of sheet T. Touching the display position of a key indicating the type of the sheet T enables the type of sheet T to be set. Examples of types of sheets T which can be set include, in addition to plain paper and OHP sheets T, thin paper, cardboard, label sheets, postcards, treated paper, and so forth. Thus, the operating panel 3 accepts input for setting the type of sheets T, including OHP sheets T.

This setting of the types of sheets T may be performed using the computer 200 that is communicably connected to the multifunctional peripheral 100. The computer displays the sheet settings screen 82, and upon the user setting the type of sheets T by using the computer 200, the computer 200 transmits the setting contents to the communication unit 7 of the multifunctional peripheral 100. Thus, settings of the type of sheets T made using the computer 200 are accepted. In this situation, the communication unit 7 serves as an input unit for accepting input of settings regarding the types of sheets Tin the cassettes 41.

In a situation where the type of sheets T is OHP sheets T, the finishing control unit 10 causes the discharge roller pair 16 to feed the sheet T is a state with the sheet T bent between the second conveying roller pair 14 and discharge roller pair 16.

Next, the finishing control unit 10 confirms whether or not the amount of bending is the predetermined bending amount, or checks whether or not a sheet is present using the discharge sensor 151 (step S4). This is because the sheet T may jam at the portion where discharge roller pair 16 is located, if the amount of bending is too great.

Specifically, a bending range where the sheet T comes into contact with the detection face 151*a* of the discharge sensor 151, but jamming does not occur, may be determined as the predetermined bending amount. Now, the difference between the feeding distance which is the feeding amount of the sheet T by the second conveying roller pair 14 from the point in time that the leading end of the sheet T reaches (or is found to have reached) the discharge roller pair 16 up to the current point in time, and the feeding distance which is the feeding amount of the sheet T by the discharge roller pair 16 form the point in time that the leading end of the sheet T is assumed to have reached the discharge roller pair 16 up to the current point in time, may be handled as being the amount of bending.

If the discharge roller pair 16 is to be stopped when the leading end of the sheet T reaches the discharge roller pair 16, the finishing control unit 10 determines that the amount of bending is the predetermined bending amount when the second conveying roller pair 14 has fed the sheet T for an amount equivalent to the predetermined bending amount from the point in time that the leading end of the sheet T reaches (or is found to have reached) the discharge roller pair 16.

On the other hand, if the discharge roller pair 16 is to be rotated slower than the second conveying roller pair 14, the finishing control unit 10 determines that the amount of bending is the predetermined bending amount when the difference between the feeding amount of the second conveying roller pair 14 and the feeding amount of the discharge roller pair 16 reaches a predetermined bending amount from the point in time that the leading end of the sheet T is considered to have reached the discharge roller pair 16.

If the amount of bending reaches the predetermined bending amount, or if the finishing control unit 10 detects the presence of a sheet based on the output of the discharge sensor 151 due to having bent the sheet T, there is no need to bend the sheet T any further. Accordingly, if the amount of bending reaches the predetermined bending amount (Yes in step S4), the finishing control unit 10 changes the feeding speed of the discharge roller pair 16 so that the sheet feeding speed of the discharge roller pair 16 and that of the second conveying roller pair 14 is the same (step S5, including starting rotation from a stopped state). In other words, the feeding distance per unit time of the two roller pairs is made the same. Thus, the sheet T is fed with the amount of bending being maintained the same. On the other hand, if the amount of bending is not the predetermined bending amount (No in step S4), the flow returns to step S3 to secure sufficient bending of the sheet T.

Eventually, the finishing control unit 10 detects that a sheet T has been discharged from the discharge roller pair 16, based on change in output of the discharge sensor 151 (change to an output value of when there is no sheet T) (step S6).

Next, the finishing control unit 10 temporarily stops the rotation of the discharge roller pair 16 (Step S7). The finishing control unit 10 then confirms whether or not discharge of all sheets T in the printing job has been completed (whether or not there are sheets T remaining for normal discharging process) (step S8). In the event that there still remain sheets T to be subjected to normal discharging process (No in step S8), the flow returns to step S1.

On the other hand, in the event that discharge of all sheets T has been completed (Yes in step S8), the finishing control unit 10 stops feeding operations of sheets T in the finisher 1 by stopping the first conveying motor 14*m* and second conveying motor 16*m*, stopping light emission of the light-emitting unit 151L of the discharge sensor 151, and so forth (step S9→end).

Thus, the finisher 1 (sheet conveying device) according to an embodiment includes: upstream side rollers (second conveying roller pair 14) configured to feed sheets T; discharge rollers (discharge roller pair 16) located downstream from the upstream side rollers in a feeding direction of sheets T, configured so as to discharge sheets T to the discharge tray 17; a reflective optical detector (discharge sensor 151) located between the discharging rollers and the upstream side rollers, configured to emit light, and to receive light reflected off of sheets T; and a recognizing unit (finishing control unit 10) configured to detect, based on output of the detector, whether or not a sheet T is present at a detection region of the detector. Multiple types of conveying paths of sheets T are provided toward the detector, with the detector being positioned so as to have a detection face 151*a* that is inclined with respect to at least one conveying path among the multiple types of conveying paths. The discharge rollers feed the sheet T in a bent state between the upstream side rollers and the discharge rollers, so that the sheet T comes close to the detector or the sheet T comes close to being perpendicular to an optical axis of the detector.

Accordingly, the distance between the sheet T and detector (discharge sensor 151) is closer, and the detector can receive reflected light from the sheet T more easily. Also, the sheet T is bent while bringing the distance between the sheet T and detector closer, so the angle of the sheet T with respect to the optical axis of the detector can be brought closer to 90 degrees when viewed from the horizontal direction. Thus, the attitude of the sheet T can be brought to an ideal angle for detection with the detector while bringing the sheet T close to the detector, so whether or not a sheet T is present can be accurately detected with a reflective optical detector even when using sheets T, through which light can pass, like OHP sheets T.

A processing tray 15 having a sheet loading face 15*a* where the detector (discharge sensor 151) is located, is situated between the upstream side rollers (second conveying roller pair 14) and the discharge rollers (discharge roller pair 16), upon which sheets T are loaded before being discharged to the discharge tray 17. In a situation of discharging a sheet T to the discharge tray 17 without loading the sheet T on the processing tray 15, the discharge rollers feed the sheet T in a bent state between the upstream side rollers and the discharge rollers, and in a situation of discharging a sheet T to the discharge tray 17 after loading the sheet T on the processing tray 15, the discharge rollers feed the sheet T without bending. Accordingly, when discharging a sheet T directly to the discharge tray 17 without loading the sheet T on the processing tray 15, the discharge rollers bend the sheet T, so even sheets T, through which light can pass, can be accurately detected with a reflective optical detector. Also, when a sheet T is loaded in the processing tray 15, the sheet T exists directly above the detector (the angle of the sheet T with respect to the optical axis is approximately 90 degrees, and the distance between the sheet T and detector is approximately zero), so whether or not a sheet T is present can be accurately detected with a reflective optical detector even when the sheets T on the processing tray 15 are OHP sheets T. Also, when a sheet T is loaded on the processing tray 15, the sheet T can be discharged without bending the sheet T, thereby facilitating smooth discharging.

Also, the discharge rollers (discharge roller pair 16) feed the sheet T in a bent state so that the sheet comes into contact with the detection face 151*a* of the detector (discharge sensor 151). Accordingly, the angle of the sheet T with respect to the optical axis of the detector is approximately 90 degrees, and the distance between the detector and sheet T can be brought into extremely close proximity. Accordingly, whether or not a sheet T is present can be accurately detected with a reflective optical detector even when using sheets T, through which light can pass, like OHP sheets T.

Also, in the event that the amount of bending of the sheet T reaches a predetermined bending amount, or presence of the sheet T is detected using the detector, the discharge rollers (discharge roller pair 16) rotate at the same sheet feeding speed as the upstream side rollers (second conveying roller pair 14). If the amount of bending of the sheet T exceeds a level where the presence of the sheet T can be detected using the detector (discharge sensor 151), this may lead to jamming of the sheet T, so the amount of bending of the sheet is restricted. Accordingly, the sheet T can be kept from excessively bending (bending amount is suppressed to a constant level) so that jamming of the sheet T does not occur.

The discharge rollers (discharge roller pair 16) bend the sheet by reducing the sheet conveying speed thereof below that of the upstream side rollers (second conveying roller pair 14), or starting rotation after the sheet T abuts the discharge rollers. Thus, the sheet T can be bent in a consistent manner.

The finisher 1 (sheet conveying device) according to an embodiment further includes an input unit (operating panel 3, communication unit 7) configured to accept input of selection of type of sheet T to be fed. When the input unit accepts that the sheet T type is an overhead transparency sheet, the discharge rollers (discharge roller pair 16) feed the sheet T in a bent state between the upstream side rollers (second conveying roller pair 14) and the discharge rollers. Thus, when feeding an OHP sheet T having conditions, such as an angle of the sheet T with regarding to the detector (discharge sensor 151), by which accurate detection is strict, the sheet T is bent. Accordingly, whether or not an OHP sheet T is present can be accurately detected with a reflective optical detector. Also, sheets T, through which light can not pass, unlike OHP sheets, are not bent, thereby facilitating smooth and speedy feeding of sheets T.

Also, an image forming apparatus (multifunctional peripheral 100) includes the above-described finisher 1 (sheet conveying device), and thus includes a sheet conveying device whereby sheets T (particularly OHP sheets T) can be accurately detected using a reflective optical sensor. Thus, an image forming apparatus can be provided which performs suitable control of feeding of sheets T without erroneous detection, even when printing using OHP sheets T is performed.

Description has been made above by way of an embodiment regarding an example of setting whether or not to perform a stapling process by using the operating panel 3. However, when image data and the like is being transmitted from the computer 200 as a printing job to be executed at the multifunctional peripheral 100, in other words when the multifunctional peripheral 100 is being used as a printer, settings of whether or not to perform stapling process may be performed from the computer 200. The communication unit 7 of the multifunctional peripheral 100 receives settings data indicating whether or not to perform a stapling process from the computer 200, along with the image data. The main control unit 6 instructs the finisher 1 whether to perform a normal discharging process or stapling process for the print job.

Also, description has been made above regarding an example of controlling the rotation of the discharge roller pair 16 of the finisher 1 to bend the sheets T. However, in the event that there are multiple conveying paths for sheets T at the roller portion of the main unit of multifunctional peripheral 100 where discharge is performed, the rotation of rollers performing discharge may be slowed down to bend the sheets T and then may discharge the sheets T in this state, rather than bending the sheets T at the finisher 1. Thus, the sheet conveying device according to an embodiment may be included in the main unit of the multifunctional peripheral 100 instead of the finisher 1.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A sheet conveying device, comprising:

upstream side rollers configured to feed sheets;

discharge rollers located downstream from the upstream side rollers in a feeding direction of the sheets, configured to discharge sheets to a discharge tray;

a processing tray having a sheet loading face, the processing tray being located between the upstream side rollers and the discharge rollers, and upon the sheet loading face sheets are loaded before being discharged to the discharge tray;

a reflective optical detector located on the sheet loading face of the processing tray between the discharge rollers and the upstream side rollers, configured to emit light, to receive light reflected off of the sheets, and to detect both sheets whose surfaces are not parallel to a detection face thereof, fed from the upstream side rollers towards the discharge rollers, and sheets whose surfaces are parallel to the detection face thereof, placed on the sheet loading face;

a recognizing unit configured to detect, based on an output of the detector, whether or not a sheet is present at a detection region of the detector; and when a sheet is fed over a conveying path inclined with respect to a detection face of the detector, the upstream side rollers feed the sheet while bending the sheet with the discharge rollers toward the detector between the upstream side rollers and the discharge rollers, so that the presence of the sheet at a detection region of the detector is detected by the recognizing unit, based on the output of the detector.

2. The sheet conveying device according to claim 1, wherein when discharging a sheet to the discharge tray without loading the sheet on the processing tray, the upstream side rollers feed the sheet in a bent state between the upstream side rollers and the discharge rollers; and when discharging a sheet to the discharge tray after loading the sheet on the processing tray, the discharge rollers feed the sheet without bending.

3. The sheet conveying device according to claim 1, wherein the upstream side rollers feed the sheet while bending the sheet with the discharge rollers so that the sheet comes into contact with a detection face of the detector.

4. The sheet conveying device according to claim 1, wherein, when the amount of bending of a sheet reaches a predetermined amount of bending, or the presence of the sheet is detected by using the detector, the discharge rollers rotate at the same sheet feeding speed as that of the upstream side rollers.

5. The sheet conveying device according to claim 1, wherein the upstream side rollers bend the sheet with the discharge rollers by reducing the sheet feeding speed of the discharge rollers below that of the upstream side roller.

6. The sheet conveying device according to claim 1, comprising:

an input unit configured to accept input of selection of type of sheet to be fed; and upon the input unit accepting that the sheet type is an overhead transparency sheet, the upstream side rollers feed the sheet while bending the sheet with the discharge rollers between the upstream side rollers and the discharge rollers.

7. An image forming apparatus, comprising:

a sheet feeding unit configured to feed sheets to a conveying unit;

a conveying unit configured to feed the sheets fed from the sheet feeding unit;

an image forming unit configured to form toner images on the sheets fed by the conveying unit;

a fixing unit configured to fix, to the sheets, the toner images formed on the sheets at the image forming unit; and a finisher configured to perform finishing on the sheets to which toner image have been fixed at the fixing unit;

the finisher comprises a sheet conveying unit, and the sheet conveying unit includes upstream side rollers configured to feed sheets, discharge rollers located downstream from the upstream side rollers in a feeding direction of the sheets, configured to discharge sheets to a discharge tray, a processing tray having a sheet loading face, the processing tray being located between the upstream side rollers and the discharge rollers, and upon the sheet loading face sheets are loaded before being discharged the discharge tray;

a reflective optical detector located on the sheet loading face of the processing tray between the discharge rollers and the upstream side rollers, configured to emit light, to receive light reflected off of the sheets, and to detect both sheets whose surfaces are not parallel to a detection face thereof, fed from the upstream side rollers towards the discharge rollers, and sheets whose surfaces are parallel to the detection face thereof, placed on the sheet loading face;

a recognizing unit configured to detect, based on an output of the detector, whether or not a sheet is present at a detection region of the detector; and when a sheet is fed over a conveying path inclined with respect to a detection face of the detector, the upstream side rollers feed the sheet while bending the sheet with the discharge rollers toward the detector between the upstream side rollers and the discharge rollers, so that the presence of the sheet at a detection region of the detector is detected by the recognizing unit, based on the output of the detector.

8. The image forming apparatus according to claim 7, wherein when discharging a sheet to the discharge tray without loading the sheet on the processing tray, the upstream side rollers feed the sheet while bending the sheet with the discharge rollers between the upstream side rollers and the discharge rollers; and when discharging a sheet to the discharge tray after loading the sheet on the processing tray, the discharge rollers feed the sheet without bending.

9. The image forming apparatus according to claim 7, wherein the upstream side rollers feed the sheet while bending the sheet with the discharge rollers so that the sheet comes into contact with a detection face of the detector.

10. The image forming apparatus according to claim 7, wherein, when the amount of bending of a sheet reaches a predetermined amount of bending, or presence of the sheet is detected by using the detector, the discharge rollers rotate at the same sheet feeding speed as that of the upstream side rollers.

11. The image forming apparatus according to claim 7, wherein the upstream side rollers bend the sheet with the discharge rollers by reducing the sheet feeding speed of the discharge rollers below that of the upstream side roller.

12. The image forming apparatus according to claim 7, comprising:

an input unit configured to accept input of selection of type of sheet to be fed; and upon the input unit accepting that the sheet type is an overhead transparency sheet, the upstream side rollers feed the sheet while bending the sheet with the discharge rollers between the upstream side rollers and the discharge rollers.

* * * * *